US008246141B2

(12) United States Patent
Petruchik et al.

(10) Patent No.: US 8,246,141 B2
(45) Date of Patent: Aug. 21, 2012

(54) INSERT MOLDED PRINTHEAD SUBSTRATE

(75) Inventors: Dwight J. Petruchik, Honeoye Falls, NY (US); Mario J. Ciminelli, Rochester, NY (US); James E. Vianco, Webster, NY (US); Eric A. Merz, Hilton, NY (US); Steven J. Dietl, Ontario, NY (US); Steven L. Moore, Dansville, NY (US)

(73) Assignee: Eastman Kodak Company, Rochester, NY (US)

( * ) Notice: Subject to any disclaimer, the term of this patent is extended or adjusted under 35 U.S.C. 154(b) by 968 days.

(21) Appl. No.: 11/614,143

(22) Filed: Dec. 21, 2006

(65) Prior Publication Data

US 2008/0149024 A1 Jun. 26, 2008

(51) Int. Cl.

| | |
|---|---|
| ***B41J 29/38*** | (2006.01) |
| ***B41J 2/015*** | (2006.01) |
| ***B41J 2/14*** | (2006.01) |

(52) U.S. Cl. ..... 347/20; 347/9; 347/50

(58) Field of Classification Search ..... 347/20, 347/9, 50

See application file for complete search history.

(56) References Cited

U.S. PATENT DOCUMENTS

| | | | | |
|---|---|---|---|---|
| 4,103,643 | A * | 8/1978 | Staunton | 118/50 |
| 6,431,683 | B1 * | 8/2002 | Ho et al. | 347/50 |
| 6,536,868 | B1 | 3/2003 | Kawamura et al. | |
| 6,824,243 | B2 | 11/2004 | Yamaguchi et al. | |
| 7,690,774 | B2 | 4/2010 | Petranek et al. | |
| 2002/0033857 | A1 * | 3/2002 | Ohashi et al. | 347/20 |
| 2005/0168513 | A1 * | 8/2005 | Wood et al. | 347/20 |

FOREIGN PATENT DOCUMENTS

| | | |
|---|---|---|
| EP | 0 652 107 | 10/1994 |

* cited by examiner

*Primary Examiner* — Jason Uhlenhake

(74) *Attorney, Agent, or Firm* — William R. Zimmerli; Peyton C. Watkins; David A. Novais

(57) ABSTRACT

A marking assembly includes a substrate and a marking device. The substrate includes a first portion made from a first material including a plurality of alignment features, and a second portion made from a second material affixed to the first portion of the substrate. The marking device is affixed to the second portion of the substrate and aligned to the alignment features of the first portion of the substrate.

7 Claims, 10 Drawing Sheets

INSERT MOLDED PRINTHEAD SUBSTRATE

FIELD OF THE INVENTION

This invention relates generally to the field of digitally controlled printing devices, and in particular to alignment of components that make up these devices.

BACKGROUND OF THE INVENTION

Liquid ejection devices that include one or more alignment features are known, see, for example, U.S. Pat. No. 6,536,868 B1, issued on Mar. 25, 2003, to Kawamura et al. and U.S. Pat. No. 6,824,243 B1, issued on Nov. 30, 2004, to Yamaguchi et al.

U.S. Pat. No. 6,536,868 to Kawamura et al., issued Mar. 25, 2003, entitled "Liquid ejection type print head, printing apparatus provided with same and a method for producing a liquid ejection type print head," discloses a print element unit. The print element unit includes a print element substrate, and a plate-like member having a surface to be adhered on which the print element substrate is positioned and fixedly adhered via heat-hardening adhesive. A first reference surface of the plate-like member is used as a positioning reference for the print element substrate. A holder member for holding tanks for storing liquid supplied to the print element substrate has a second reference surface that is engaged with the first reference surface of the plate-like member and with a reference surface of a mounting portion of a carriage member. When the second reference surfaces are engaged with the first surface, the print element unit and the holder member are fixedly adhered to each other via a hardening adhesive at a low (normal) temperature.

U.S. Pat. No. 6,824,243 to Yamaguchi et al., issued Nov. 30, 2004, entitled "Liquid jet print head and liquid jet printing apparatus," discloses a liquid jet print head that includes a printing unit, a printing device substrate and a supporting substrate. Projections of the supporting substrate are used as a reference for positioning when the printing device substrate is attached to the supporting substrate and when the print head is installed in a carriage of a printer. Further, all reference portions used for positioning in the three-dimensional directions when installing the print head in the carriage are gathered in the printing unit.

Typically, the alignment features are formed in a plate, also referred to as a supporting member, to which the printing device substrate is attached to in these types of liquid ejection devices. The material used for the plate is usually a ceramic material that is expensive when compared to other materials such as plastic. As a consequence, the size and the complexity of the plate are kept to a minimum in order to reduce overall printhead cost. As a result, the distance between the alignment features is constrained. This may lead to alignment errors, for example, rotation alignment errors, when the printhead is mounted to the print carriage which can cause printed drop placement error ultimately resulting in reduced image quality.

As such, there is a need to reduce alignment errors associated with mounting of a printhead to a print carriage without significantly increasing printhead cost.

SUMMARY OF THE INVENTION

According to one feature of the invention, a marking assembly includes a substrate and a marking device. The substrate includes a first portion made from a first material and including a plurality of alignment features, and a second portion made from a second material affixed to the first portion of the substrate. The marking device is affixed to the second portion of the substrate and aligned to the alignment features of the first portion of the substrate.

According to another feature of the invention, a printer includes a marking assembly and a print carriage. The marking assembly includes a substrate and a marking device. The substrate includes a first portion made from a first material and including a plurality of alignment features, and a second portion made from a second material affixed to the first portion of the substrate. The marking device is affixed to the second portion of the substrate and aligned to the alignment features of the first portion of the substrate. The marking assembly is aligned to the print carriage with the plurality of alignment features of the first portion of the substrate.

According to another feature of the invention, a method of manufacturing a marking assembly includes providing a substrate including a first portion made from a first material and including a plurality of alignment features, and a second portion made from a second material affixed to the first portion of the substrate; positioning a marking device relative to the second portion of the substrate using the alignment features of the first portion of the substrate; and affixing the marking device to the second portion of the substrate.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
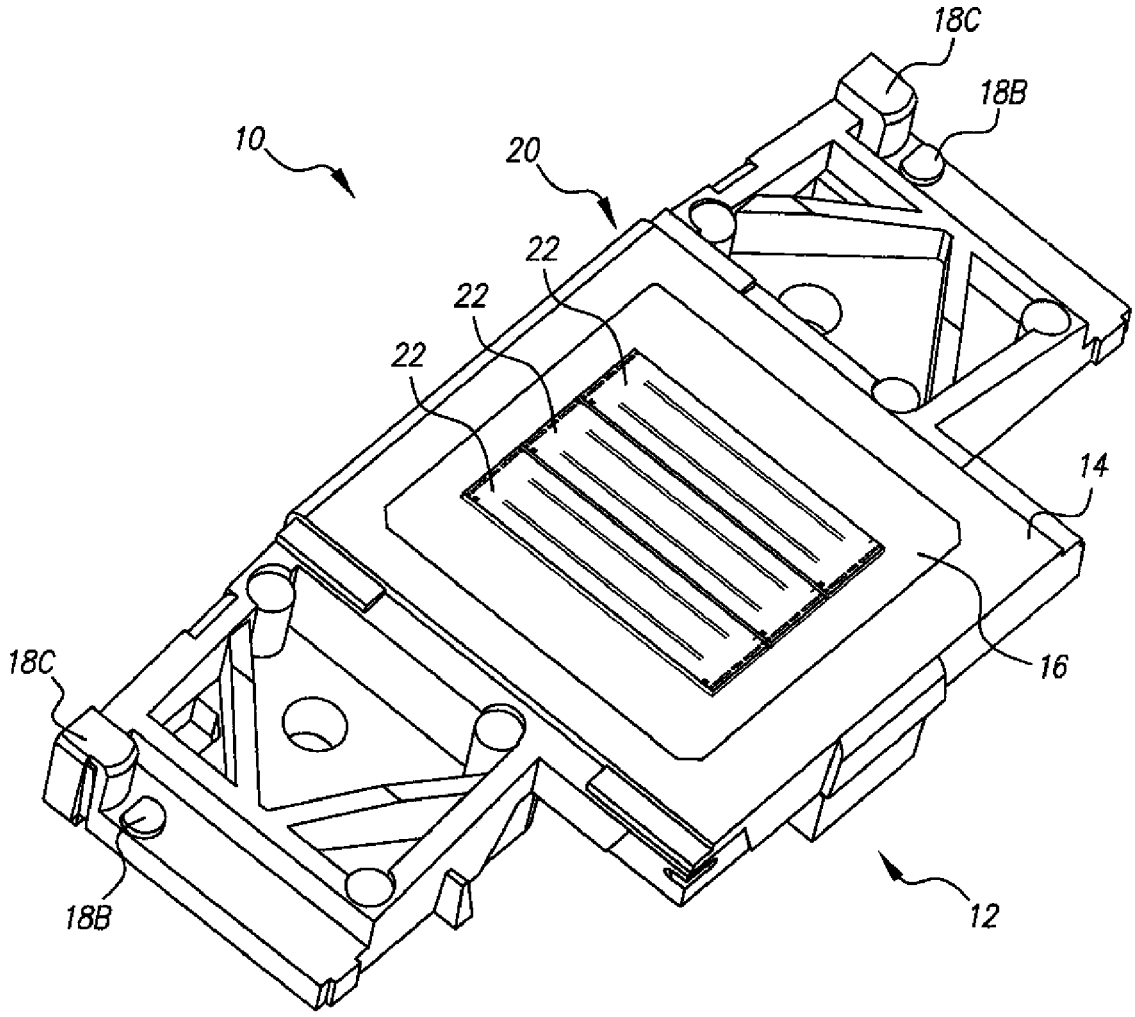
FIG. 1 is a perspective top view of an example embodiment of the invention showing a marking assembly including a marking device mounted on a single substrate.

Referring to FIG. 1, a marking assembly 10 is shown. Marking assembly 10 includes a substrate 12. Substrate 12 includes a first portion 14 made from a first material and a second portion 16 made from a second material affixed to the first portion 14 of substrate 12. First portion 14 of substrate 12 includes a plurality of alignment features 18B, 18C.

A marking device 20 is affixed to second portion 16 of substrate 12 and is aligned to alignment features 18B, 18C of first portion 14 of substrate 12. In FIG. 1, marking device 20 includes multiple ejector dies 22, typically made from a silicon material, and is operable to eject fluid supplied to marking device 20 from a fluid tank (not shown) in a conventional manner.

Figure 2:
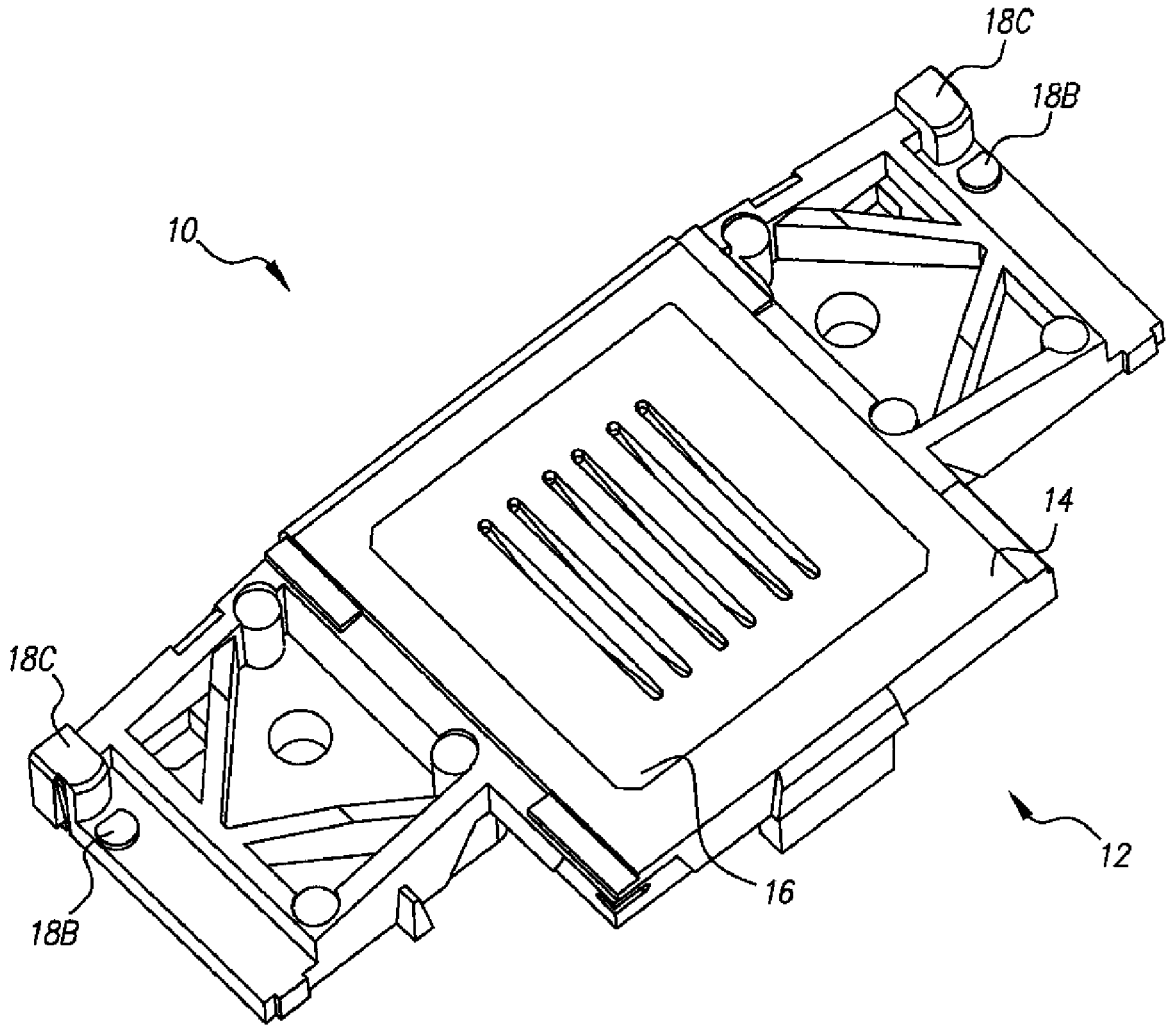
FIG. 2 is a perspective top view of the example embodiment shown in FIG. 1 without the marking device mounted on the single substrate.
Figure 3:
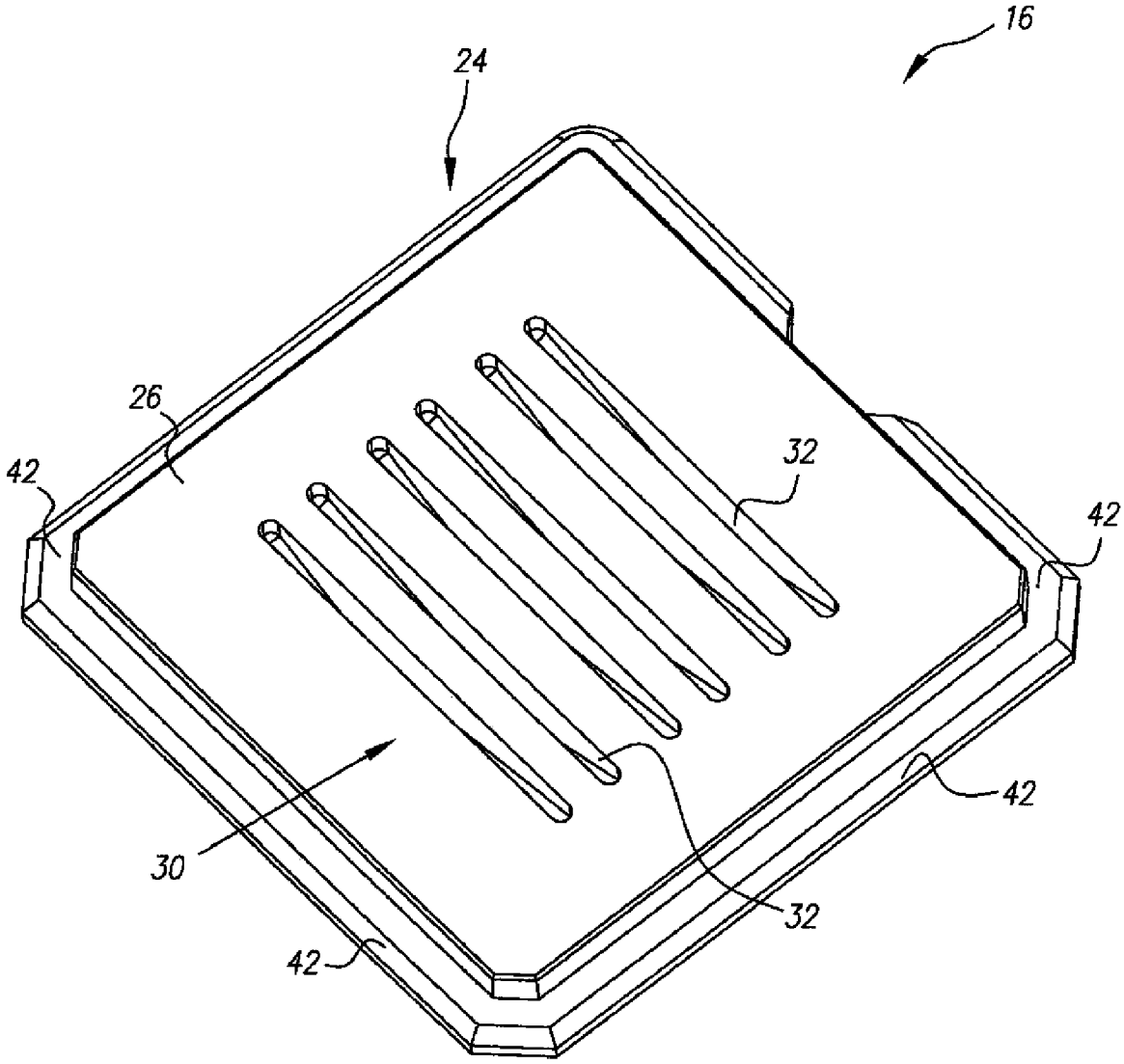
FIG. 3 is a perspective view of a first portion of the single substrate.
Figure 4:
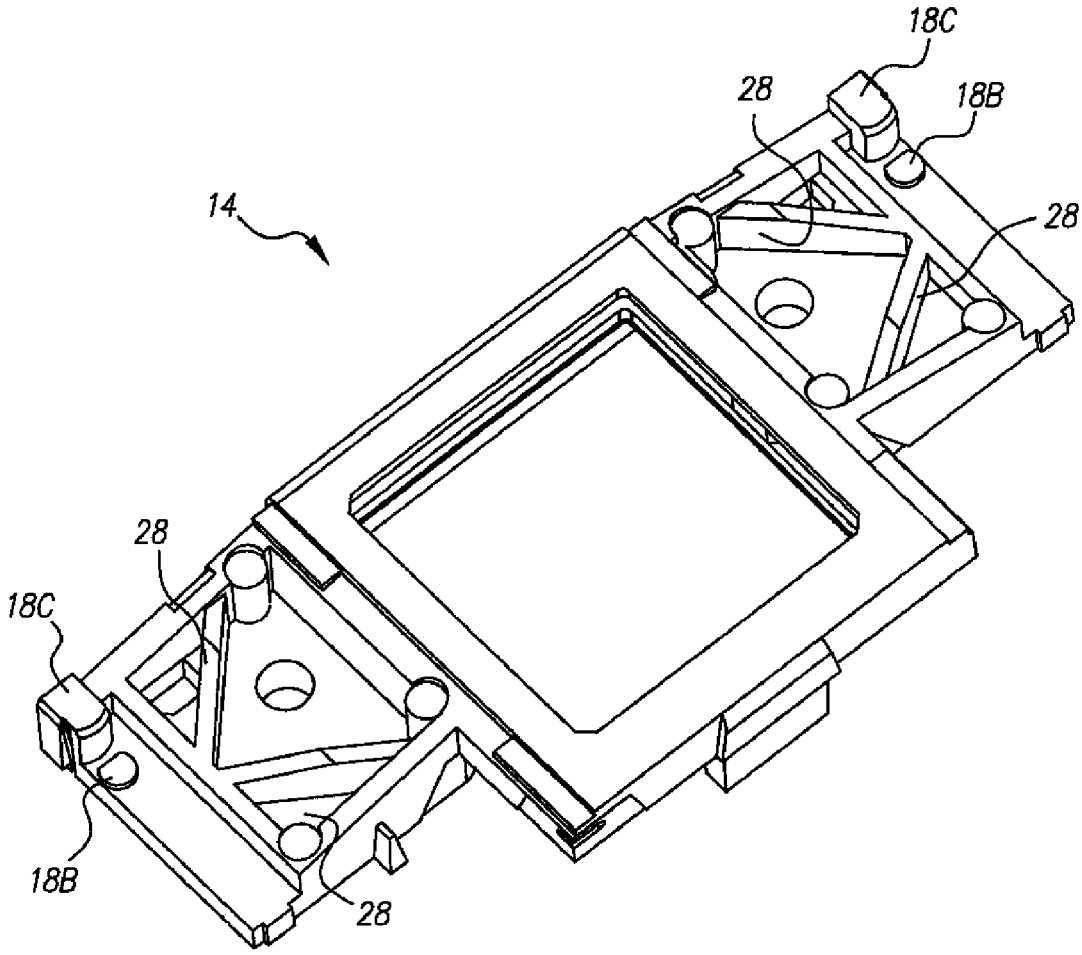
FIG. 4 is a perspective view of a second portion of the single substrate.

Referring to FIGS. 2 through 4, marking assembly 10 is shown without marking device 20 affixed thereto. Second portion 16 of substrate 12 is affixed to first portion 14 of substrate 12 by integrally forming first portion 14 around existing second portion 16. For example, second portion 16 can be an insert 24 made from a ceramic material that is insert molded into first portion 14 made from a plastic material. In this sense, a single substrate 12 is formed. Second portion 16 can be provided with a lip 42 that helps to anchor or secure second portion 16 in first portion 14 during the molding process. Lip 42 can extend from a portion of the periphery of second portion 16 or from all sides of second portion 16. In this example, the molding process used is an injection molding process although other types of molding processes can be used.

Using a ceramic material for second portion 16 of substrate 12 is advantageous because ceramic provides a mounting surface 26 for marking device 20 that is flat, stable, and thermally conductive. Using a plastic material for first portion 14 of substrate 12 is advantageous because plastic is much lower in cost when compared to other materials, for example, ceramic, particularly when first portion 14 of substrate 12 includes complex shapes. Accordingly, distances between alignment features 18B, 18C of substrate 12 can be increased when compared to alignment features formed in other materials, for example, ceramic, without significantly increasing printhead cost. Increasing the distances between alignment features 18B, 18C reduces alignment errors associated with printhead-print carriage mounting and results in reduced printed drop placement error during printer operation.

Other mechanical features can be incorporated, for example, molded into first portion 14 of substrate 12 when first portion 14 is made from a plastic material. In the example described with reference to FIGS. 2 through 4, one or more ribs 28 have been included in first portion 14 of substrate 12. Rib(s) 28 is sized, shaped, and positioned on first portion 14 so as to improve or increase the mechanical strength of substrate 12. It should be noted that in the case of fabrication by insert molding, first portion 14 of substrate 12 does not exist independently of second portion 16, as shown in FIG. 4, but is rather formed around second portion 16. Accordingly, substrate 12 is considered a single substrate.

The materials selected for first portion 14 and second portion 16 of substrate 12 help to minimize thermal mechanical stress in marking device the silicon ejector die. When one or more of the materials selected include materials having high thermal conductive properties, heat dissipation is increased and may result in the elimination of a separate heat sink component.

First portion 14 is made from a first material and second portion 16 is made from a second material that have substantially similar thermal expansion coefficients. In the example described above, the ceramic material used for second portion 16 is 96% alumina and has a thermal coefficient of expansion (CTE) that is an adequate match to the silicon material used in ejector die 22. The plastic used for first portion 14 is glass filled plastic material, for example, Noryl GFN3 (30% glass filled), and has a thermal coefficient of expansion (CTE) that is an adequate match to the ceramic material of second portion 16. In addition to being an adequate CTE match, the plastic material of first portion 14 of substrate 12 was chosen to be a highly glass filled plastic to increase the mechanical strength of substrate 12 in order to minimize movement of the ceramic die mounting surface 26 during printhead manufacturing and use.

Figure 5:
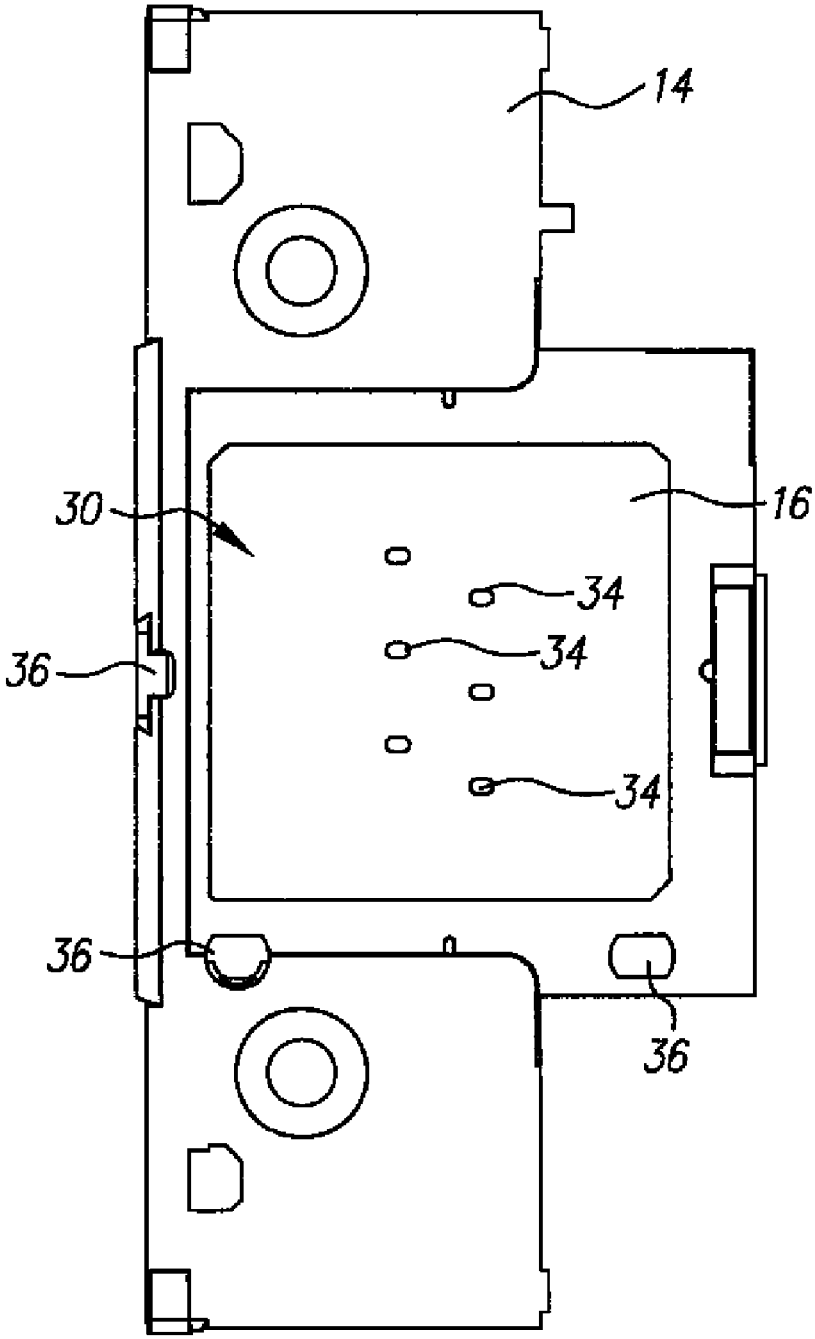
FIG. 5 is a perspective bottom view of the example embodiment shown in FIG. 1.

Second portion 16 of substrate 12 includes at least one fluid manifold 30 formed therein. Typically, fluid manifold 30 includes one or more fluid channels 32 (as shown in FIG. 3) and/or fluid ports 34 (as shown in FIG. 5), etc. Fluid manifold 30 provides fluid communication from a fluid tank (not shown) to marking device 20.

Referring back to FIGS. 1, 2, and 4, and to FIG. 5, first portion 14 of substrate 12 includes one or more alignment features 18B, 18C located or formed thereon. In this example embodiment, alignment features 18B and 18C are located on opposite ends of first portion 14 of substrate 12. However, the specific location of alignment features 18B and 18C on first portion 14 of substrate 12 can vary in other embodiments. Marking device 20 and ejector dies 22 are directly aligned to alignment features 18B, 18C of first portion 14 of substrate 12.

Figure 10:
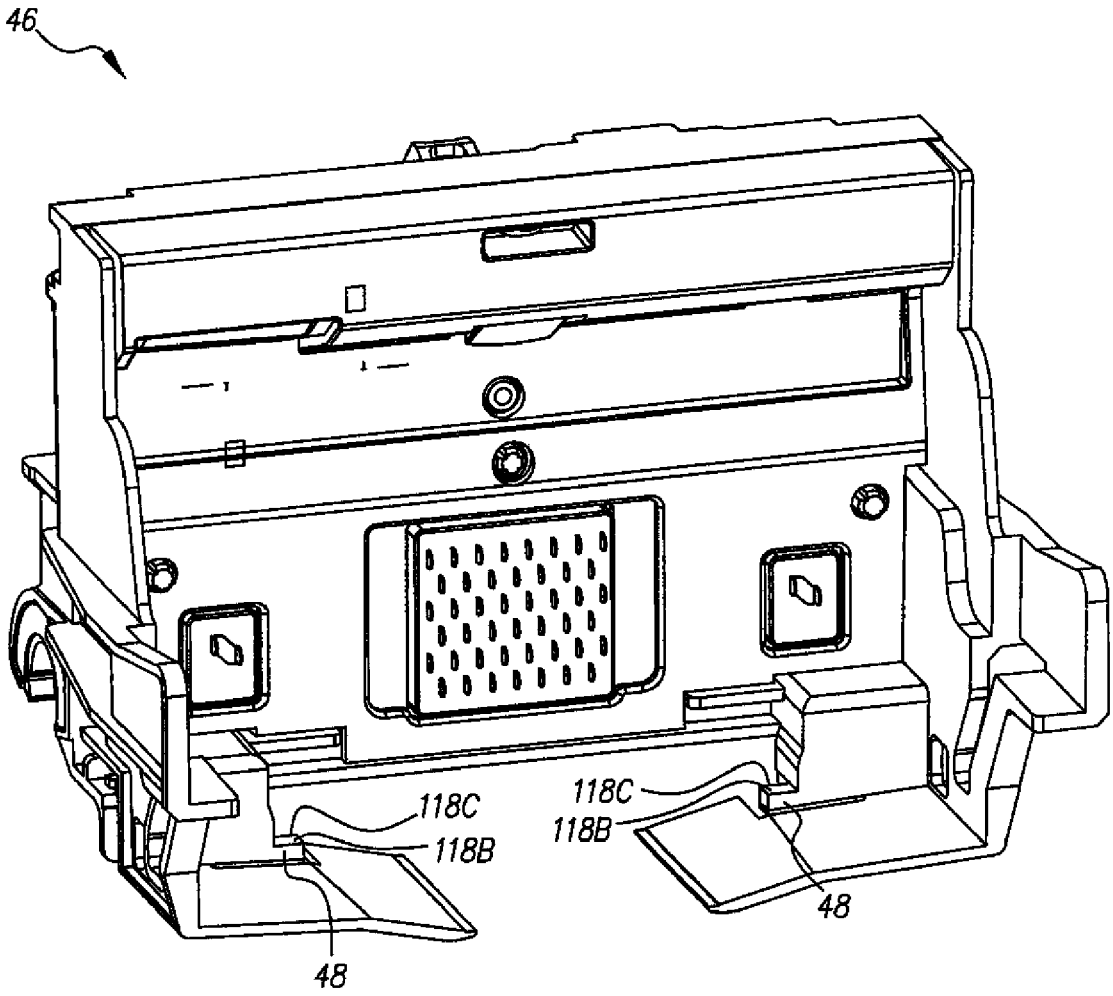
FIG. 10 is a perspective view of a printer carriage.

Commonly referred to as datums, alignment features 18B, 18C are used when mounting printhead or mounting marking assembly 10 to a printer carriage of a printer (as shown in FIG. 10). Alignment features 18B, 18C align marking assembly 10 relative to the printer carriage. Additionally, alignment features 18B define front to back and angular position of ejector die 22 relative to alignment features 18B of substrate 12 (and ultimately front to back and angular position of ejector die 22 relative to the printer carriage of the printer) while alignment features 18C define side to side position of ejector die 22 relative to alignment features 18C of substrate 12 (and ultimately side to side position of ejector die 22 relative to the printer carriage of the printer).

Typically, alignment features 18B, 18C are projections molded into first portion 14 of substrate 12. The number, shape, and size of alignment features 18B, 18C can vary depending on the specific application contemplated. In FIGS. 1 and 2, there are two alignment features 18B, each having a circular cross section, and two alignment features 18C, each having a substantially rectangular cross section with one rounded side. However, the specific shape and size of alignment features 18B and 18C can vary in other embodiments.

Second portion 16 of substrate 12 is accurately aligned with alignment features 18B, 18C of substrate 12 during the insert molding process. One or pins (not shown) are used in the mold to align second portion 16 to alignment features 18B, 18C of substrate 12. Typically, one or more indentations 36 are formed in first portion 14 of substrate 12 as a result of using one or more pins to align second portion 16 relative to alignment features 18B, 18C of substrate 12.

Figure 6:
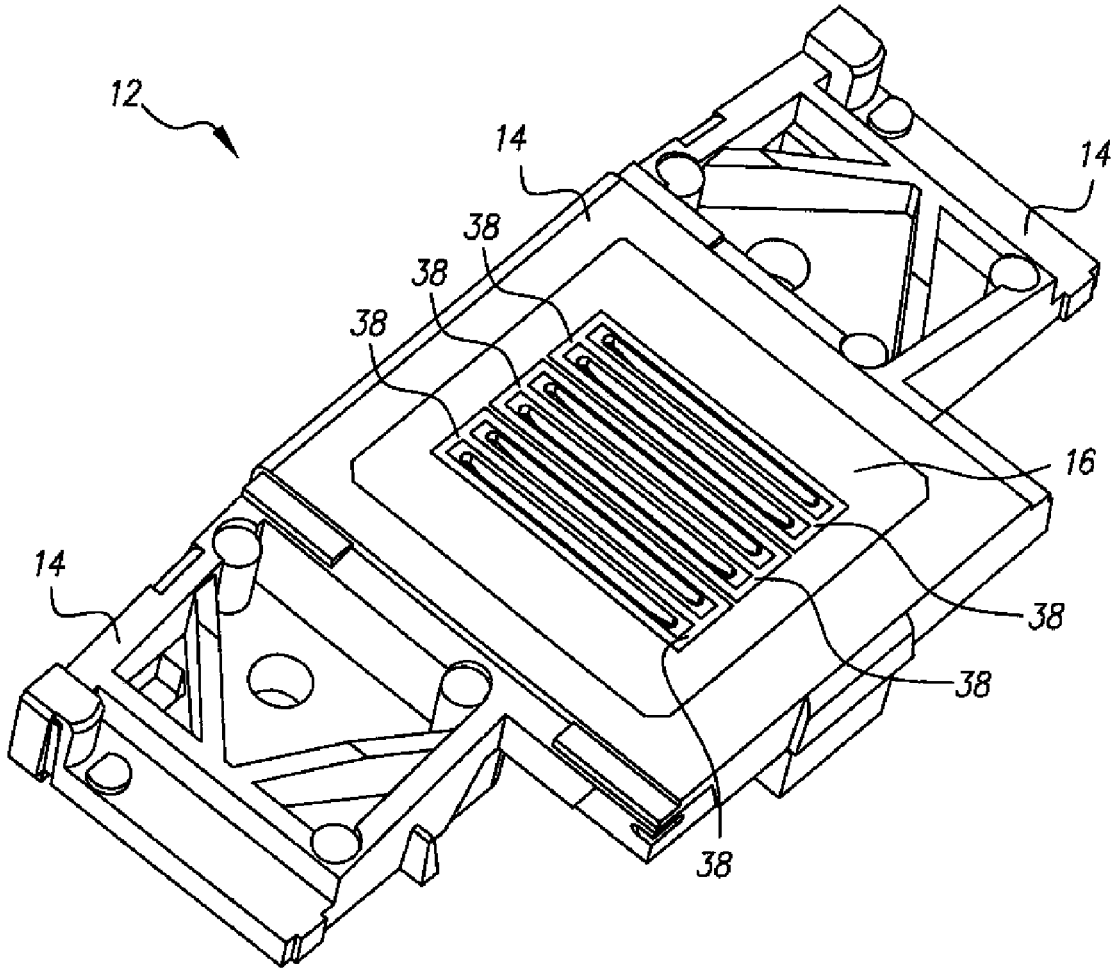
FIG. 6 is a perspective top view of the example embodiment shown in FIG. 1.
Figure 7:
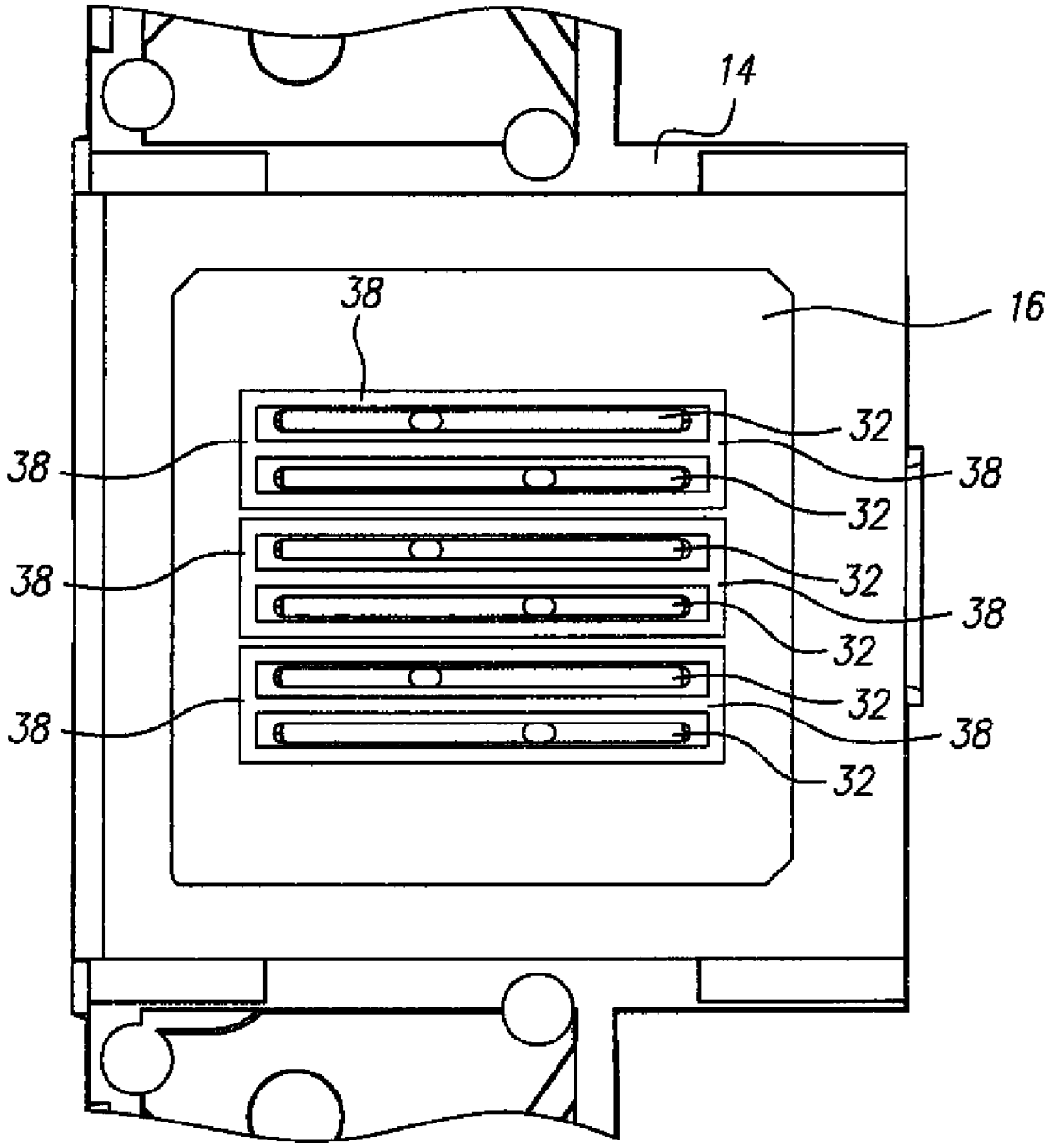
FIG. 7 is a top view of a portion of the example embodiment shown in FIG. 6.

Referring to FIGS. 6 and 7 and back to FIG. 1, after marking device 20 and/or ejector dies 22 are positioned relative to second portion 16 of substrate 12 and aligned relative to the alignment features 18B, 18C located on first portion 14 of substrate 12, marking device 20 and/or ejector dies 22 are affixed to second portion 16 of substrate 12 using, for example, an adhesive 38. Adhesive 38 can be a thermally conductive adhesive (silver filled) in order to maximize heat transfer away from ejector die 22 during printing. Adhesive 38 can cover die mounting surface 26 of second portion 16 of substrate 12 with the exception of fluid channels 32.

Figure 8:
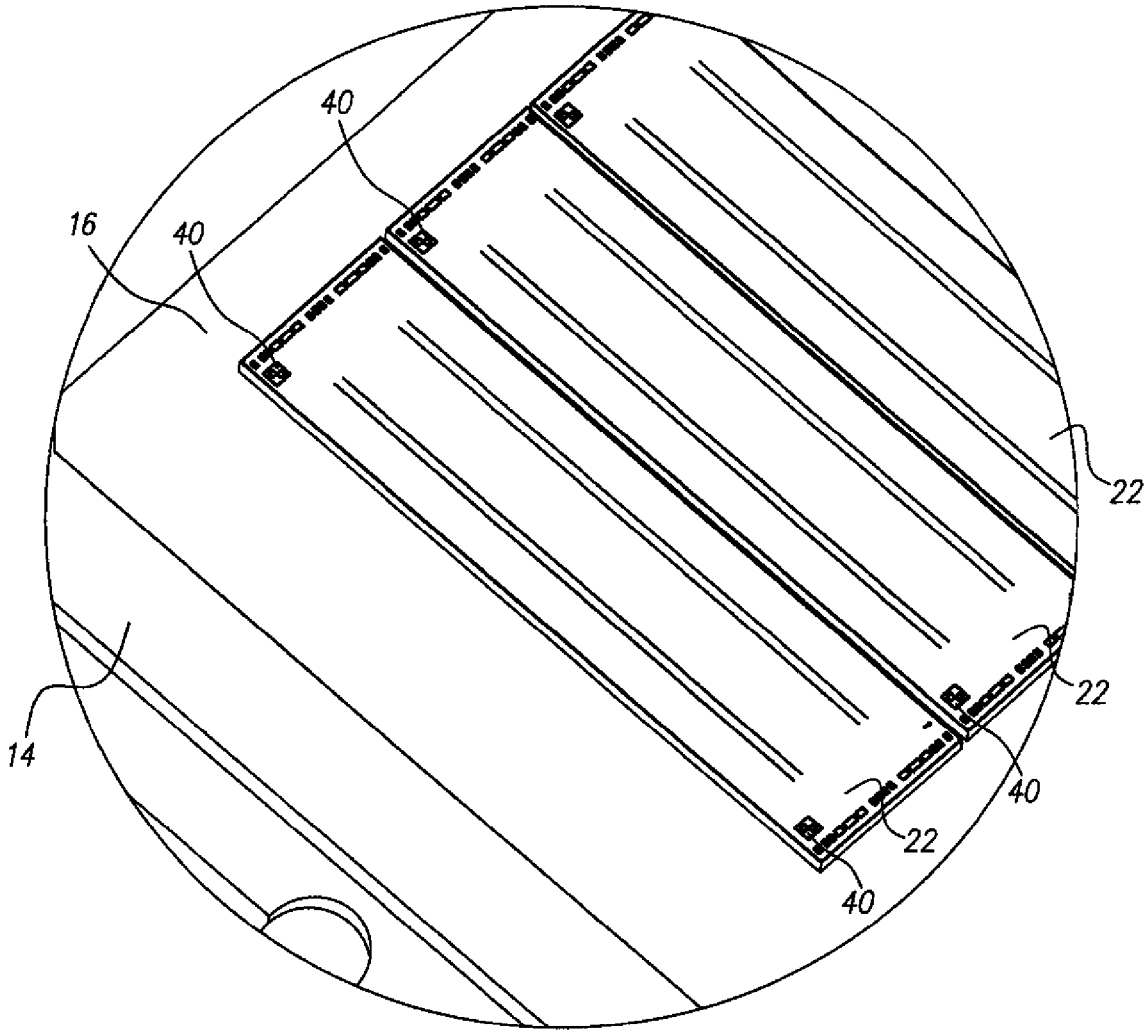
FIG. 8 is a perspective view of a portion of the marking device shown in FIG. 1.

Referring to FIG. 8, drop placement on a receiver is typically one of the most critical specifications of a printer. The printhead or marking device 20 contributor to this specification is the placement of ejector dies 22 with respect to alignment features 18B, 18C. Accordingly, a mechanical nest is used to mount substrate 12 during the ejector die 22 placement process. This nest has vision targets near alignment features 18B, 18C. Each ejector die 22 includes one or more fiducials 40 formed as part of the silicon wafer processing so that they are accurate to a sub-micron level with respect to actual nozzle features. The vision targets and fiducials 40 allow each ejector die 22 to be precisely aligned relative to alignment features 18B, 18C. The ability to precisely place ejector die 22 with respect to alignment features 18B, 18C is advantageous because it helps to reduce printed drop placement errors associated with the mounting of printhead or marking device 20 to a print carriage of a printer.

Figure 9:
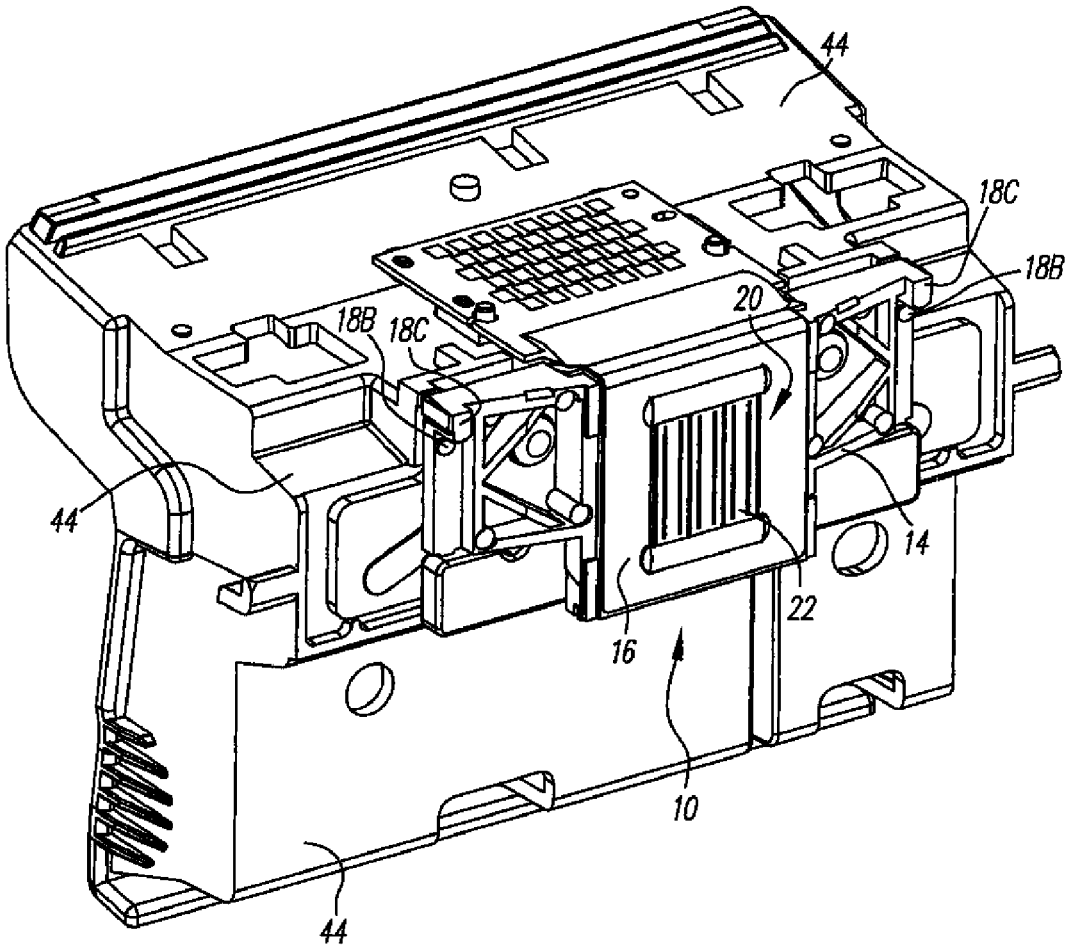
FIG. 9 is a perspective view of the marking assembly shown in FIG. 1 mounted to a print cartridge.

Referring to FIG. 9, marking assembly 10 is shown attached or mounted to a print cartridge 44. In addition to holding the marking assembly 10, print cartridge 44 may also hold one or more fluid tanks (not shown). Attachment of marking assembly 10 to print cartridge 44 can be accomplished using conventional methods. For example, fasteners, such as screws, can be used. Alternatively, marking assembly 10 can be welded, using a spot welding process, to print cartridge 44. The plurality of alignment features 18B and 18C of first portion 14 of substrate 12 are still accessible after marking assembly 10 has been mounted in print cartridge 44.

Referring to FIG. 10, print cartridge 44 is subsequently mounted to or inserted into the carriage of the printer, commonly referred to as a printer carriage 46. Printer carriage 46 includes a plurality datum reference features 48. As shown in FIG. 10, printer carriage 46 is a molded plastic component of the printer. Typically, reference features 48 are projections formed during the molding process associated with forming printer carriage 46. The number, shape, and size of reference features 48 can vary depending on the specific application contemplated. In FIG. 10, there are two references features 48, each having a substantially rectangular shape. However, the specific shape and size of reference features 48 can vary in other embodiments.

Reference features 48 each include surfaces 118B and 118C corresponding to alignment features 18B and 18C. As shown in FIG. 10, surfaces 118B and 118C are planar although other configurations are possible that correspond to include. Alignment features 18B and 18C are used to guide print cartridge 44 (and marking assembly 10) into position relative to printer carriage 46 during mounting ultimately contacting surfaces 118B and 118C, respectively, of references features 48. Accordingly, the plurality of alignment features 18B and 18C are used to mechanically align print cartridge 44 (and marking assembly 10) with printer carriage 46. As discussed above, alignment features 18B and 18C are also used to align ejector die(s) 22 of marking device 20 when ejector die(s) 22 is affixed to second portion 16 of substrate 12.

Using the same alignment features (or a single set of alignment features) for both purposes helps to reduce alignment errors associated with mounting marking assembly 10 to printer carriage 46 by reducing the number of sets of alignment features needed to affix ejector die 22 to substrate 12 and mount marking assembly 10 to printer carriage 46. Additionally, when compared to prior art devices, alignment errors associated with mounting marking assembly 10 to printer carriage 46 are also reduced due to the increased distances between alignment features 18B, 18C of substrate 12.

The invention has been described in detail with particular reference to certain preferred embodiments thereof, but it will be understood that variations and modifications can be effected within the scope of the invention.

PARTS LIST

10 marking assembly
12 substrate
14 first portion
16 second portion
18B alignment features
18C alignment features
20 marking device
22 ejector die
24 insert
26 mounting surface
28 ribs
30 fluid manifold
32 fluid channels
34 fluid ports
36 indentations
38 adhesive
40 fiducials
42 lip
44 print cartridge
46 printer carriage
48 reference features
118B surface
118C surface

The invention claimed is:

1. A printer comprising:

(I) a marking assembly comprising:

(a) a substrate including a first portion made from a first material and including first and second alignment features, and a second portion made from a second material; wherein the second portion includes a periphery and the first portion is attached via insert molding around the periphery of the second portion; wherein the substrate is a single substrate having only the first and second portions so that any additional physical components are not used as any portion of the single substrate;

(b) a marking device affixed to the second portion of the substrate and directly aligned to the first and second alignment features of the first portion of the substrate; and (II) a printer carriage including a plurality of datum features, wherein the marking assembly is aligned to the printer carriage by the plurality of datum features and the first and second alignment features of the first portion of the substrate.

2. The printer of claim 1, wherein the first material and the second material have substantially similar thermal expansion coefficients.

3. The printer of claim 1, wherein the first material is a glass filled plastic material.

4. The printer of claim 1, wherein the second material is a ceramic material.

5. The printer of claim 1, wherein the second portion of the substrate includes at least one fluid manifold.

6. The printer of claim 1, wherein the second portion includes a lip that extends from a portion of the periphery.

7. The printer of claim 1, wherein the second portion includes a lip that extends from a side of the second portion.

* * * * *